US010309228B2

(12) United States Patent
Dutta et al.

(10) Patent No.: US 10,309,228 B2
(45) Date of Patent: Jun. 4, 2019

(54) IMPINGEMENT INSERT FOR A GAS TURBINE ENGINE

(71) Applicant: General Electric Company, Schenectady, NY (US)

(72) Inventors: Sandip Dutta, Greenville, SC (US); Kassy Moy Hart, Greenville, SC (US)

(73) Assignee: General Electric Company, Schenectady, NY (US)

( * ) Notice: Subject to any disclaimer, the term of this patent is extended or adjusted under 35 U.S.C. 154(b) by 476 days.

(21) Appl. No.: 15/177,370

(22) Filed: Jun. 9, 2016

(65) Prior Publication Data

US 2017/0356299 A1 Dec. 14, 2017

(51) Int. Cl.

| | |
|---|---|
| ***F01D 5/18*** | (2006.01) |
| ***F01D 9/06*** | (2006.01) |
| ***F01D 11/24*** | (2006.01) |

(52) U.S. Cl.

CPC ..... *F01D 5/189* (2013.01); *F01D 9/065* (2013.01); *F01D 11/24* (2013.01); *F05D 2240/11* (2013.01); *F05D 2250/232* (2013.01); *F05D 2250/323* (2013.01); *F05D 2250/324* (2013.01); *F05D 2260/201* (2013.01)

(58) Field of Classification Search

CPC ..... F01D 5/189; F01D 11/24; F01D 9/065; F05D 2250/324; F05D 2250/232; F05D 2250/323; F05D 2240/11; F05D 2260/201

See application file for complete search history.

(56) References Cited

U.S. PATENT DOCUMENTS

| | | | | |
|---|---|---|---|---|
| 4,992,025 | A * | 2/1991 | Stroud | F01D 5/186 416/97 R |
| 5,533,864 | A * | 7/1996 | Nomoto | F01D 5/186 415/115 |
| 6,000,908 | A * | 12/1999 | Bunker | F01D 5/189 165/908 |
| 6,386,825 | B1 | 5/2002 | Burdgick | |
| 6,554,563 | B2 * | 4/2003 | Noe | F01D 5/189 415/115 |
| 6,634,859 | B2 * | 10/2003 | Weigand | F01D 5/187 415/115 |
| 7,375,962 | B2 | 5/2008 | Campbell et al. | |
| 7,926,278 | B2 * | 4/2011 | Gerendas | F23R 3/002 60/725 |

(Continued)

*Primary Examiner* — Carlos A Rivera
*Assistant Examiner* — Adam W Brown
(74) *Attorney, Agent, or Firm* — Dority & Manning, P.A.

(57) ABSTRACT

The present disclosure is directed to an impingement insert for a gas turbine engine. The impingement insert includes an insert wall having an inner surface and an outer surface spaced apart from the inner surface. A nozzle extends outwardly from the outer surface of the insert wall. The nozzle includes an outer surface and a circumferential surface. The insert wall and the nozzle collectively define a cooling passage extending from the inner surface of the insert wall to the outer surface of the nozzle. The cooling passage includes an inlet portion, a throat portion, a converging portion extending from the inlet portion to the throat portion, an outlet portion, and a diverging portion extending from the throat portion to the outlet portion. The cooling passage further includes a cross-sectional shape having a semicircular portion and a non-circular portion.

16 Claims, 10 Drawing Sheets

(56) References Cited

U.S. PATENT DOCUMENTS

| | | | | |
|---|---|---|---|---|
| 8,127,553 | B2 * | 3/2012 | Ekkad | F23R 3/06 60/752 |
| 8,529,193 | B2 * | 9/2013 | Venkataramanan | F01D 5/186 415/115 |
| 8,628,292 | B2 * | 1/2014 | Maltson | F01D 5/186 415/115 |
| 9,039,371 | B2 | 5/2015 | Lee et al. | |
| 9,145,789 | B2 * | 9/2015 | Adavikolanu | F01D 11/24 |
| 9,151,173 | B2 * | 10/2015 | Maldonado | F01D 5/189 |
| 9,347,324 | B2 * | 5/2016 | Lee | F01D 5/188 |
| 9,394,798 | B2 * | 7/2016 | Crites | F01D 5/186 |
| 9,995,151 | B2 * | 6/2018 | Sezer | F01D 5/189 |
| 2009/0317258 | A1 * | 12/2009 | Tibbott | F01D 5/187 416/97 R |
| 2013/0081401 | A1 * | 4/2013 | Kim | F23R 3/06 60/772 |
| 2014/0341723 | A1 | 11/2014 | Bourassa | |

* cited by examiner

IMPINGEMENT INSERT FOR A GAS TURBINE ENGINE

FIELD OF THE TECHNOLOGY

The present disclosure generally relates to a gas turbine engine. More particularly, the present disclosure relates to an impingement insert for a gas turbine engine.

BACKGROUND

A gas turbine engine generally includes a compressor section, a combustion section, a turbine section, and an exhaust section. The compressor section progressively increases the pressure of a working fluid entering the gas turbine engine and supplies this compressed working fluid to the combustion section. The compressed working fluid and a fuel (e.g., natural gas) mix within the combustion section and burn in a combustion chamber to generate high pressure and high temperature combustion gases. The combustion gases flow from the combustion section into the turbine section where they expand to produce work. For example, expansion of the combustion gases in the turbine section may rotate a rotor shaft connected, e.g., to a generator to produce electricity. The combustion gases then exit the gas turbine via the exhaust section.

The turbine section includes one or more turbine nozzles, which direct the flow of combustion gases onto one or more turbine rotor blades. The one or more turbine rotor blades, in turn, extract kinetic energy and/or thermal energy from the combustion gases, thereby driving the rotor shaft. In general, each turbine nozzle includes an inner side wall, an outer side wall, and one or more airfoils extending between the inner and the outer side walls. Since the one or more airfoils are in direct contact with the combustion gases, it may be necessary to cool the airfoils.

In certain configurations, cooling air is routed through one or more inner cavities defined by the airfoils. Typically, this cooling air is compressed air bled from compressor section. Bleeding air from the compressor section, however, reduces the volume of compressed air available for combustion, thereby reducing the efficiency of the gas turbine engine.

BRIEF DESCRIPTION OF THE TECHNOLOGY

Aspects and advantages of the technology will be set forth in part in the following description, or may be obvious from the description, or may be learned through practice of the technology.

In one aspect, the present disclosure is directed to an impingement insert for a gas turbine engine. The impingement insert includes an insert wall having an inner surface and an outer surface spaced apart from the inner surface. A nozzle extends at least one of outwardly from the outer surface of the insert wall and inwardly from the inner surface of the insert wall. The nozzle includes an outer surface and a circumferential surface. The insert wall and the nozzle collectively define a cooling passage extending from the inner surface of the insert wall to the outer surface of the nozzle. The cooling passage includes an inlet portion, a throat portion, a converging portion extending from the inlet portion to the throat portion, an outlet portion, and a diverging portion extending from the throat portion to the outlet portion. The cooling passage further includes a cross-sectional shape having a semicircular portion and a non-circular portion.

A further aspect of the present disclosure is directed to a gas turbine engine having a compressor section, a combustion section, a turbine section, and a gas turbine engine component. An impingement insert is positioned within the gas turbine engine component. The impingement insert includes an insert wall having an inner surface and an outer surface spaced apart from the inner surface. A nozzle extends at least one of outwardly from the outer surface of the insert wall and inwardly from the inner surface of the insert wall. The nozzle includes an outer surface and a circumferential surface. The insert wall and the nozzle collectively define a cooling passage extending from the inner surface of the insert wall to the outer surface of the nozzle. The cooling passage includes an inlet portion, a throat portion, a converging portion extending from the inlet portion to the throat portion, an outlet portion, and a diverging portion extending from the throat portion to the outlet portion. The cooling passage further includes a cross-sectional shape having a semicircular portion and a non-circular portion.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode thereof, directed to one of ordinary skill in the art, is set forth in the specification, which makes reference to the appended FIGS., in which.

Figure 1:
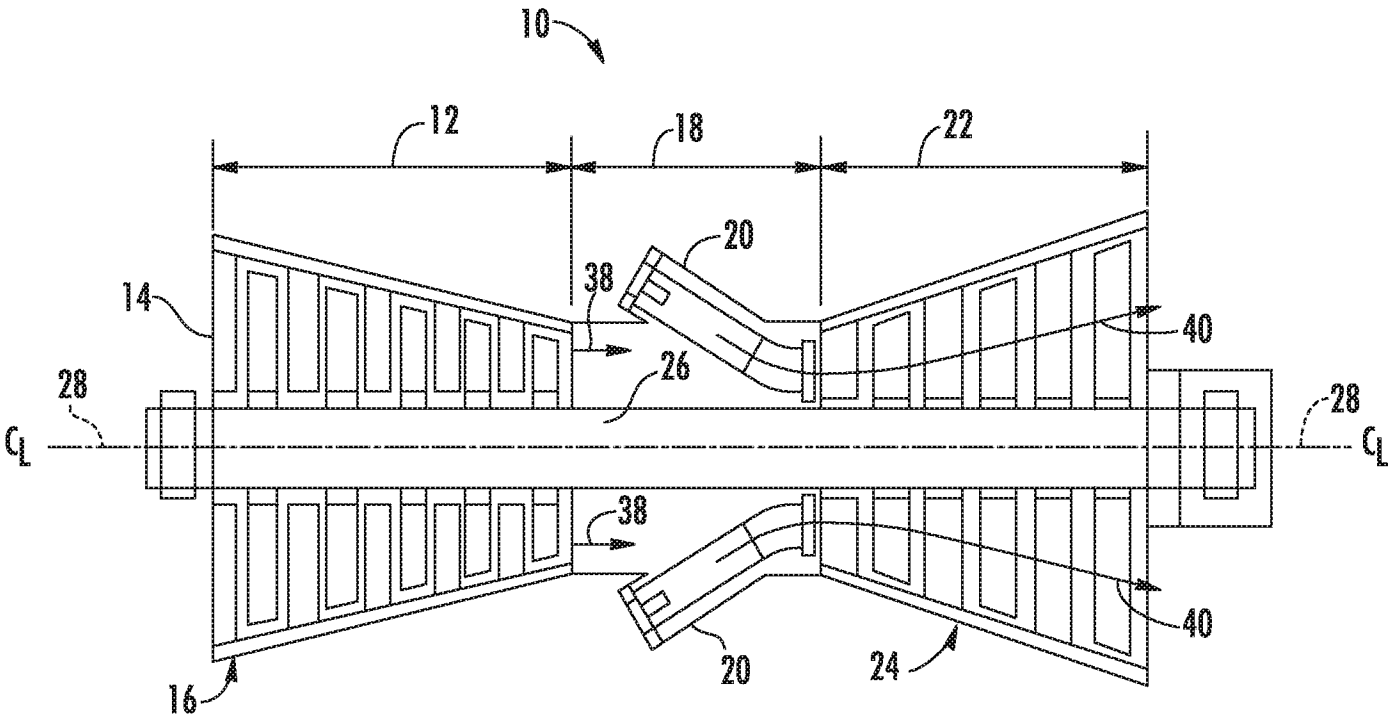
FIG. 1 is a schematic view of an exemplary gas turbine engine that may incorporate various embodiments disclosed herein.

Repeat use of reference characters in the present specification and drawings is intended to represent the same or analogous features or elements of the present technology.

DETAILED DESCRIPTION OF THE TECHNOLOGY

Reference will now be made in detail to present embodiments of the technology, one or more examples of which are illustrated in the accompanying drawings. The detailed description uses numerical and letter designations to refer to features in the drawings. Like or similar designations in the drawings and description have been used to refer to like or similar parts of the technology. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Each example is provided by way of explanation of the technology, not limitation of the technology. In fact, it will be apparent to those skilled in the art that modifications and variations can be made in the present technology without departing from the scope or spirit thereof. For instance, features illustrated or described as part of one embodiment may be used on another embodiment to yield a still further embodiment. Thus, it is intended that the present technology covers such modifications and variations as come within the scope of the appended claims and their equivalents. Although an industrial or land-based gas turbine is shown and described herein, the present technology as shown and described herein is not limited to a land-based and/or industrial gas turbine unless otherwise specified in the claims. For example, the technology as described herein may be used in any type of turbine including, but not limited to, aviation gas turbines (e.g., turbofans, etc.), steam turbines, and marine gas turbines.

Referring now to the drawings, FIG. 1 is a schematic of an exemplary gas turbine engine 10 as may incorporate various embodiments disclosed herein. As shown, the gas turbine engine 10 generally includes a compressor section 12 having an inlet 14 disposed at an upstream end of an axial compressor 16. The gas turbine engine 10 further includes a combustion section 18 having one or more combustors 20 positioned downstream from the compressor 16. The gas turbine engine 10 also includes a turbine section 22 having a turbine 24 (e.g., an expansion turbine) disposed downstream from the combustion section 18. A shaft 26 extends axially through the compressor 16 and the turbine 24 along an axial centerline 28 of the gas turbine engine 10.

Referring now to the drawings, FIG. 1 is a schematic view of an exemplary gas turbine engine 10 that may incorporate various embodiments disclosed herein. As shown, the gas turbine engine 10 generally includes a compressor section 12 having an inlet 14 disposed at an upstream end of a compressor 16 (e.g., an axial compressor). The gas turbine engine 10 also includes a combustion section 18 having one or more combustors 20 positioned downstream from the compressor 16. The gas turbine engine 10 further includes a turbine section 22 having a turbine 24 (e.g., an expansion turbine) disposed downstream from the combustion section 18. A rotor shaft 26 extends axially through the compressor 16 and the turbine 24 along an axial centerline 28 of the gas turbine engine 10.

Figure 2:
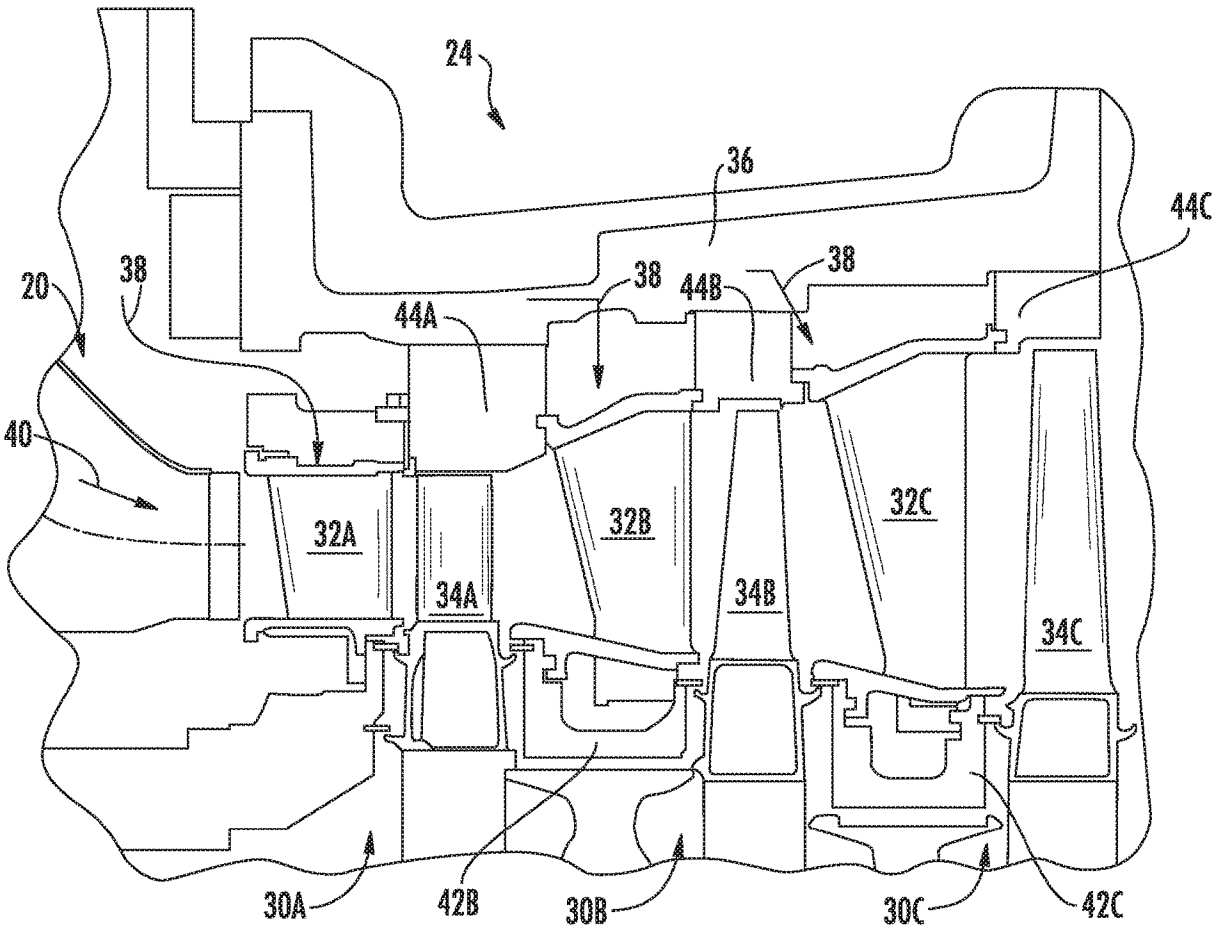
FIG. 2 is a cross-sectional view of an exemplary turbine section that may be incorporated in the gas turbine engine shown in FIG. 1 and may incorporate various embodiments disclosed herein.

FIG. 2 is a cross-sectional side view of the turbine 24, which may incorporate various embodiments disclosed herein. As shown in FIG. 2, the turbine 24 may include multiple turbine stages. For example, the turbine 24 may include a first stage 30A, a second stage 30B, and a third stage 30C. Although, the turbine 24 may include more or less turbine stages as is necessary or desired.

Each stage 30A-30C includes, in serial flow order, a corresponding row of turbine nozzles 32A, 32B, and 32C and a corresponding row of turbine rotor blades 34A, 34B, and 34C axially spaced apart along the rotor shaft 26 (FIG. 1). Each of the turbine nozzles 32A-32C remains stationary relative to the turbine rotor blades 34A-34C during operation of the gas turbine 10. Each of the rows of turbine nozzles 32B, 32C is respectively coupled to a corresponding diaphragm 42B, 42C. Although not shown in FIG. 2, the row of turbine nozzles 32A may also couple to a corresponding diaphragm. A first turbine shroud 44A, a second turbine shroud 44B, and a third turbine shroud 44C circumferentially enclose the corresponding row of turbine blades 34A-34C. A casing or shell 36 circumferentially surrounds each stage 30A-30C of the turbine nozzles 32A-32C and the turbine rotor blades 34A-34C.

As illustrated in FIGS. 1 and 2, the compressor 16 provides compressed air 38 to the combustors 20. The compressed air 38 mixes with fuel (e.g., natural gas) in the combustors 20 and burns to create combustion gases 40, which flow into the turbine 24. The turbine nozzles 32A-32C and turbine rotor blades 34A-34C extract kinetic and/or thermal energy from the combustion gases 40. This energy extraction drives the rotor shaft 26. The combustion gases 40 then exit the turbine 24 and the gas turbine engine 10. As will be discussed in greater detail below, a portion of the compressed air 38 may be used as a cooling medium for cooling the various components of the turbine 24 including, inter alia, the turbine nozzles 32A-32C.

Figure 3:
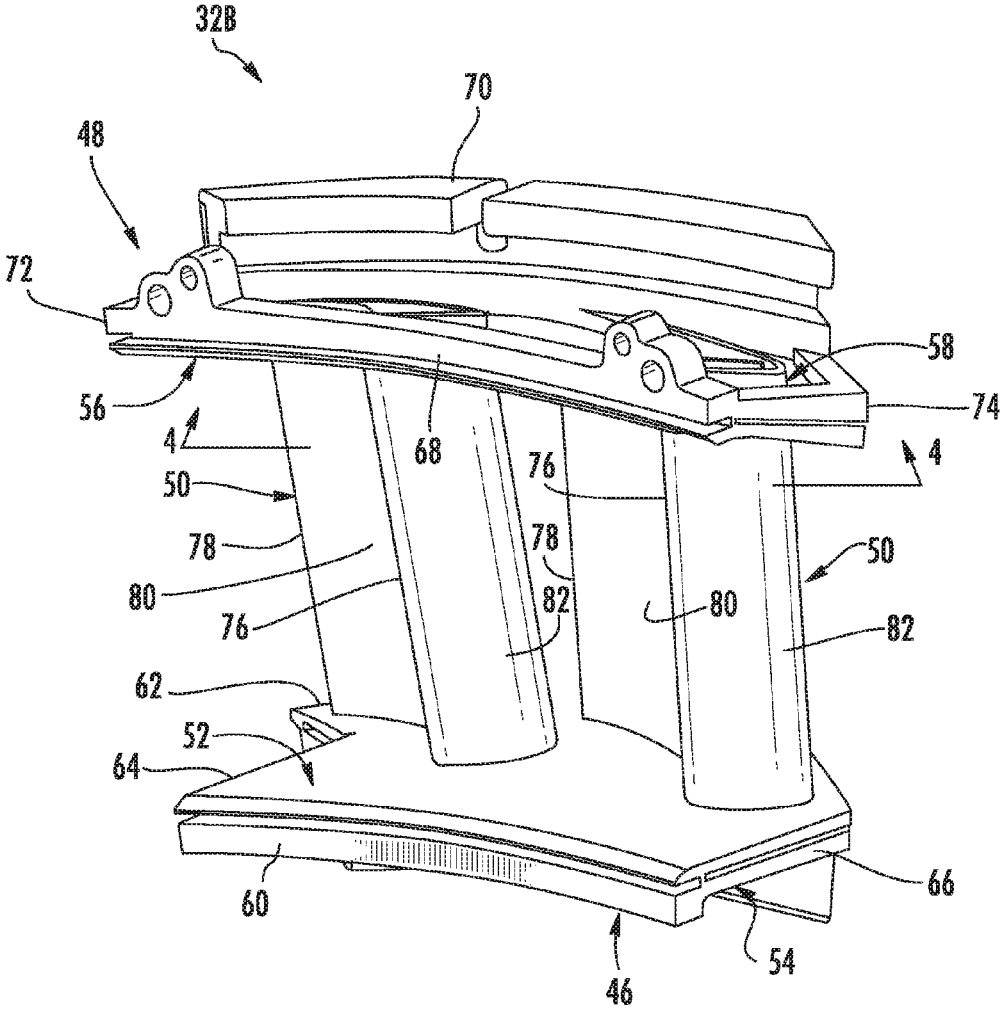
FIG. 3 is a perspective view of an exemplary nozzle that may be incorporated into the turbine section shown in FIG. 2 and may incorporate various embodiments disclosed herein.

FIG. 3 is a perspective view of the turbine nozzle 32B of the second stage 30B, which may also be known in the industry as the stage two nozzle or S2N. The other turbine nozzles 32A, 32C include features similar to those of the turbine nozzle 32B, which will be discussed in greater detail below. As shown in FIG. 3, the turbine nozzle 32B includes an inner side wall 46 and an outer side wall 48 radially spaced apart from the inner side wall 46. A pair of airfoils 50 extends in span from the inner side wall 46 to the outer side wall 48. In this respect, the turbine nozzle 32B illustrated in FIG. 3 is referred to in the industry as a doublet. Nevertheless, the turbine nozzle 32B may have only one airfoil 50 (i.e., a singlet), three airfoils 50 (i.e., a triplet), or more airfoils 50.

As illustrated in FIG. 3, the inner and the outer side walls 46, 48 include various surfaces. More specifically, the inner side wall 46 includes a radially outer surface 52 and a radially inner surface 54 positioned radially inwardly from the radially outer surface 52. Similarly, the outer side wall 48 includes a radially inner surface 56 and a radially outer surface 58 oriented radially outwardly from the radially inner surface 56. As shown in FIGS. 2 and 3, the radially inner surface 56 of the outer side wall 48 and the radially outer surface 52 of the inner side wall 46 respectively define the inner and outer radial flow boundaries for the combustion gases 40 flowing through the turbine 24. The inner side wall 46 also includes a forward surface 60 and an aft surface 62 positioned downstream from the forward surface 60. The inner side wall 46 further includes a first circumferential surface 64 and a second circumferential surface 66 circumferentially spaced apart from the first circumferential surface 64. Similarly, the outer side wall 48 includes a forward surface 68 and an aft surface 70 positioned downstream from the forward surface 68. The outer side wall 48 also includes a first circumferential surface 72 and a second circumferential surface 74 spaced apart from the first circumferential surface 72. The inner and the outer side walls 46, 48 are preferably constructed from a nickel-based superalloy or another suitable material capable of withstanding the combustion gases 40.

Figure 4:
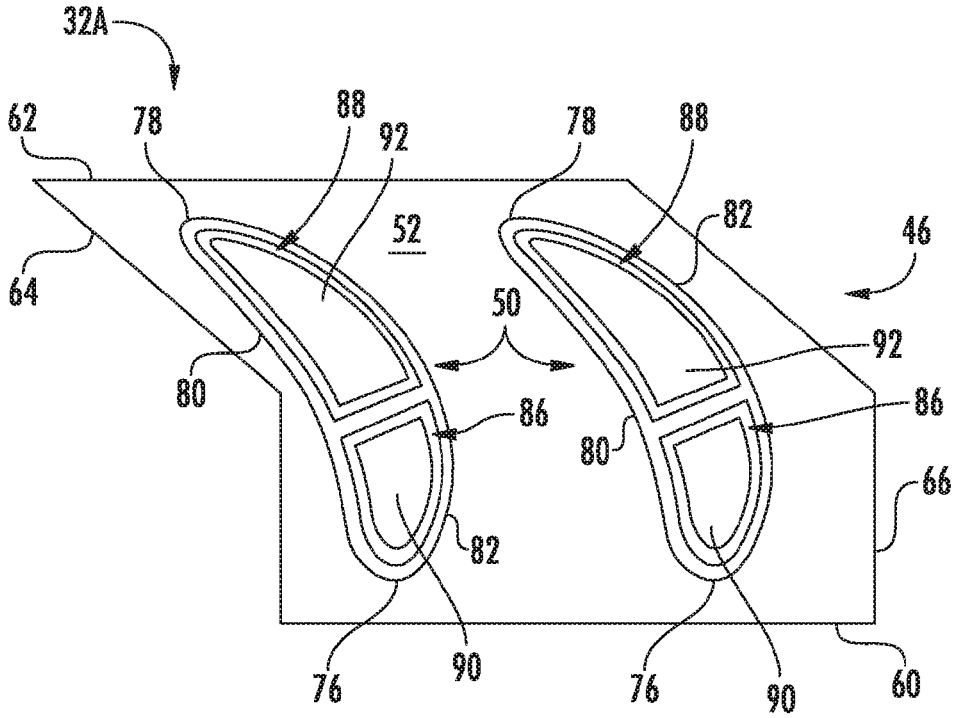
FIG. 4 is a cross-sectional view of the nozzle taken generally about line 4-4 in FIG. 3, further illustrating the features thereof.

As mentioned above, two airfoils 50 extend from the inner side wall 46 to the outer side wall 48. As illustrated in FIGS. 3 and 4, each airfoil 50 includes a leading edge 76 disposed proximate to the forward surfaces 60, 68 of the inner and the outer side walls 46, 48. Each airfoil 50 also includes a trailing edge 78 disposed proximate to the aft surfaces 62, 70 of the inner and the outer side walls 46, 48. Furthermore, each airfoil 50 includes a pressure side wall 80 and an opposing suction side wall 82 extending from the leading edge 76 to the trailing edge 78. The airfoils 50 are preferably constructed from a nickel-based superalloy or another suitable material capable of withstanding the combustion gases 40.

Each airfoil 50 may define one or more inner cavities therein. An insert may be positioned in each of the inner cavities to provide the compressed air 38 (e.g., via impingement cooling) to the pressure-side and suction-side walls 80, 82 of the airfoil 50. In the embodiment illustrated in FIG. 4, each airfoil 50 defines a forward inner cavity 86 having forward insert 90 positioned therein and an aft inner cavity 88 having an aft insert 92 positioned therein. A rib 94 (FIG. 5) may separate the forward and aft inner cavities 86, 88. Nevertheless, the airfoils 50 may define one inner cavity, three inner cavities, or four or more inner cavities in alternate embodiments. Furthermore, some or all of the inner cavities may not include inserts in certain embodiments as well.

FIGS. 5-8 illustrate embodiments of an impingement insert 100, which may be incorporated into the gas turbine engine 10. In particular, the impingement insert 100 may be positioned in the forward inner cavity 86 of one of the airfoils 50 in the nozzle 32B in place of the forward insert 90 shown in FIG. 4.

As illustrated in FIGS. 5-8, the impingement insert 100 defines an axial direction A, a radial direction R, and a circumferential direction C. In general, the axial direction A extends parallel to the axial centerline 28, the radial direction R extends orthogonally outward from the axial centerline 28, and the circumferential direction C extends concentrically around the axial centerline 28.

Figure 5:
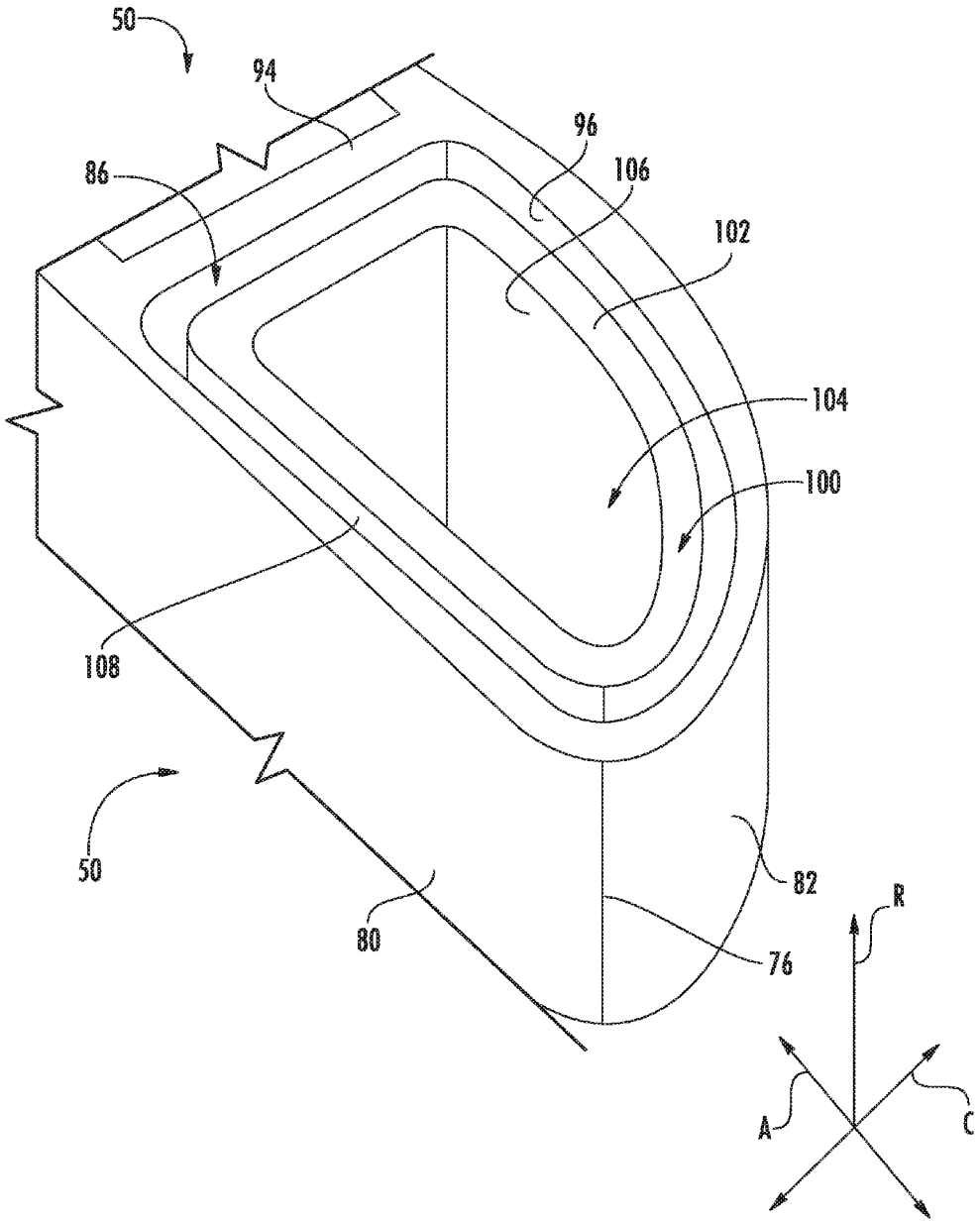
FIG. 5 is a perspective view of a portion of the nozzle shown in FIGS. 3 and 4, illustrating an impingement insert positioned therein.
Figure 6:
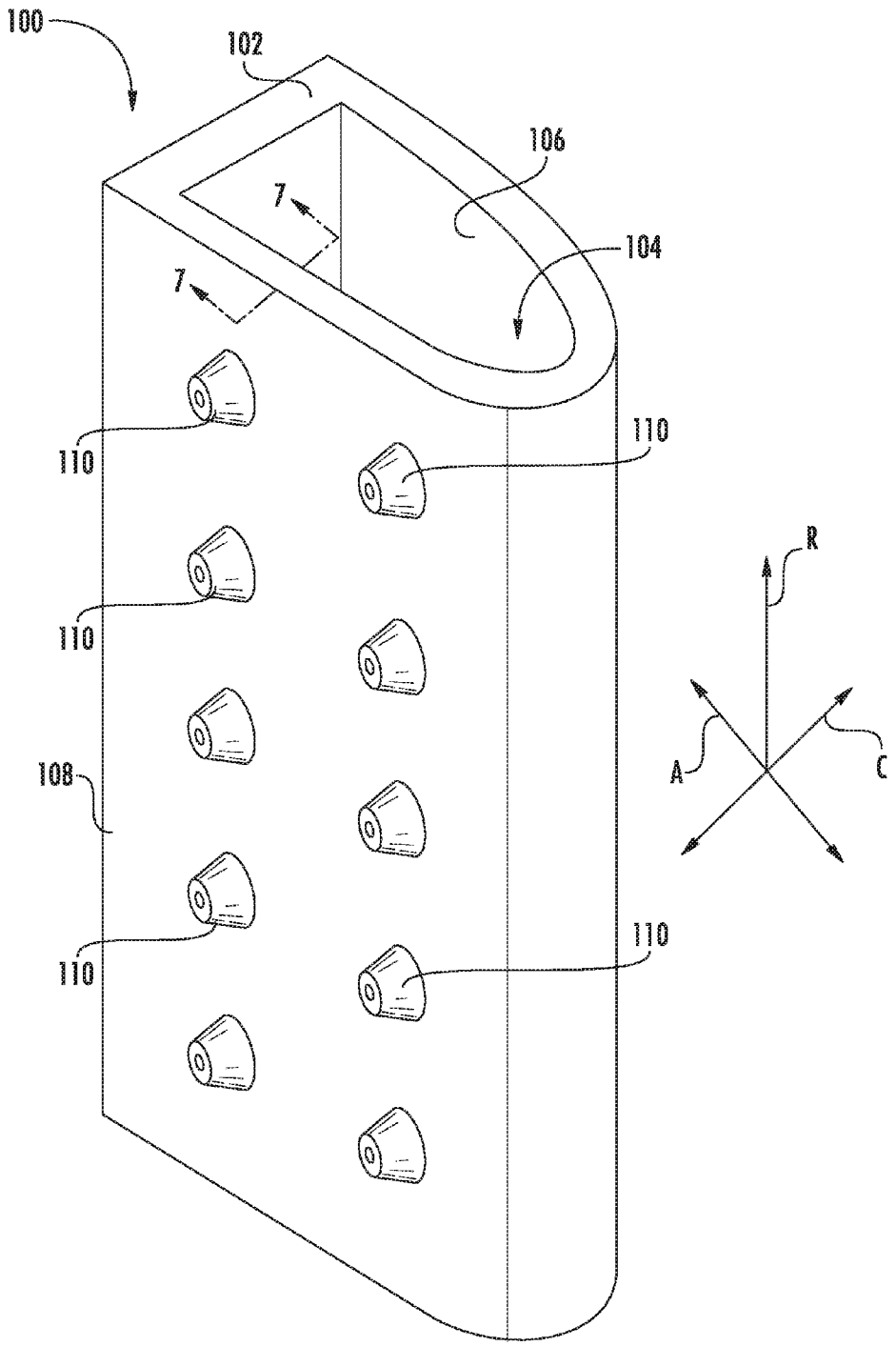
FIG. 6 is a perspective view of the impingement insert shown in FIG. 5, which may incorporate various embodiments disclosed herein.

As illustrated in FIGS. 5 and 6, the impingement insert 100 includes a generally tubular insert wall 102 that defines an inner cavity 104 therein. In this respect, the insert wall 102 includes an inner surface 106, which forms the outer boundary of the inner cavity 104, and an outer surface 108 spaced apart from the inner surface 106. In the embodiment illustrated in FIG. 5, the insert wall 102 generally has a D-shape. Although, the insert wall 102 may have any suitable shape (e.g., annular) in other embodiments as well.

Referring particularly to FIG. 6, the impingement insert 100 includes a plurality of nozzles 110 extending outwardly from the outer surface 108 of the insert wall 102. In the embodiment shown in FIG. 6, the impingement insert 100 includes ten nozzles 110 positioned in two rows each having five nozzles 110. The nozzles 110 are spaced apart within the rows in a manner that provides sufficient impingement cooling to the airfoil 50 as will be discussed in greater detail below. Preferably, the rows of nozzles 110 extend along substantially the entire radial length of the insert wall 102. Although, the rows of nozzles 110 may extend along only a portion of the radial length of the insert wall 102 as well. Nevertheless, the plurality of nozzles 110 may be arranged in any suitable manner on the insert wall 102. Furthermore, any number of nozzles 110 may extend outwardly from the outer surface 108 of the insert wall 102 so long as at least one nozzle 110 extends outwardly therefrom.

Referring again to FIG. 5, the impingement insert 100 is spaced apart from the pressure-side wall 80, the suction-side wall 82, and the rib 94 of the airfoil 50. As illustrated therein, an inner surface 96 of the airfoil 50 (i.e., of the pressure-side wall 80, the suction-side wall 82, and the rib 94) forms the outer boundary of the forward inner cavity 86. The impingement insert 100 is positioned within the forward inner cavity 86 in such a manner that the outer surface 108 of the insert wall 102 and the plurality of nozzles 110 are axially and/or circumferentially spaced apart from the inner surface 96 of the pressure-side wall 80, the suction-side wall 82, and the rib 94. The spacing between the nozzles 110 and the inner surface 96 of the airfoil 50 should be sized to facilitate impingement cooling of the inner surface 96 as will be discussed in greater detail below.

Figure 7:
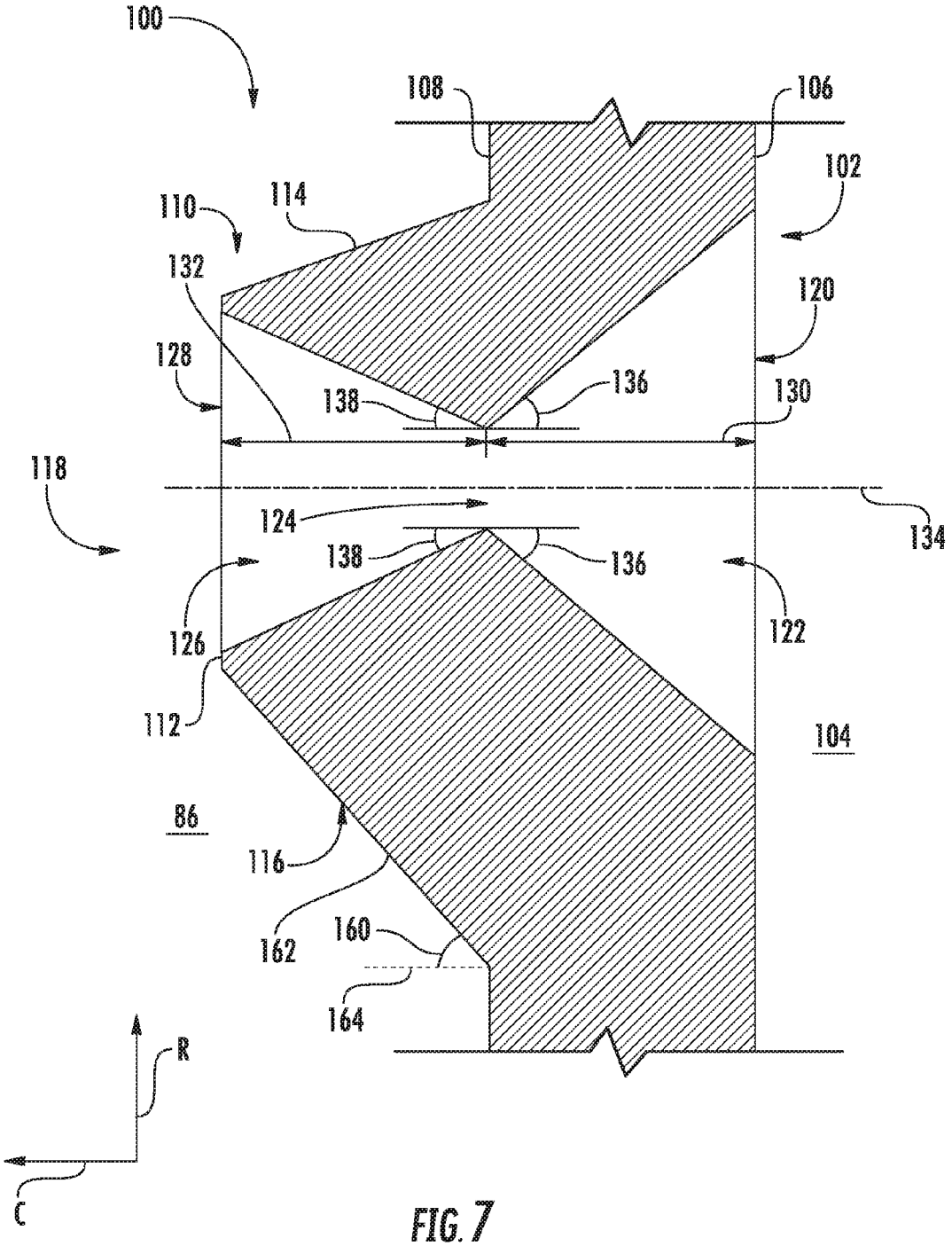
FIG. 7 is a partial cross-sectional view of the impingement insert taken generally about line 7-7 in FIG. 6, illustrating a nozzle and a cooling passage.
Figure 8A:
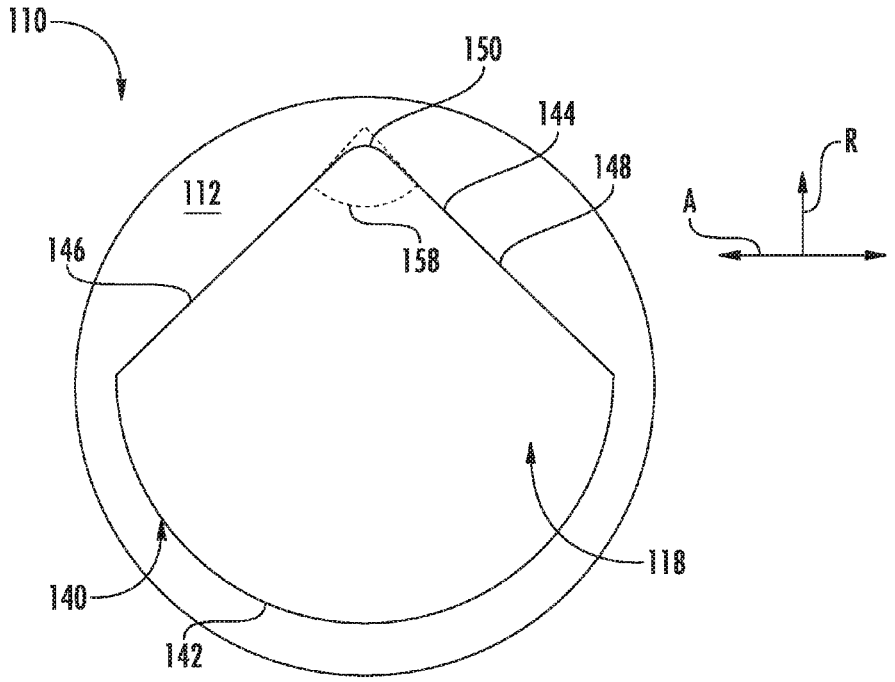
FIG. 8A is a front view of the nozzle shown in FIG. 6, illustrating one embodiment of a cross-sectional shape of the cooling passage.
Figure 8B:
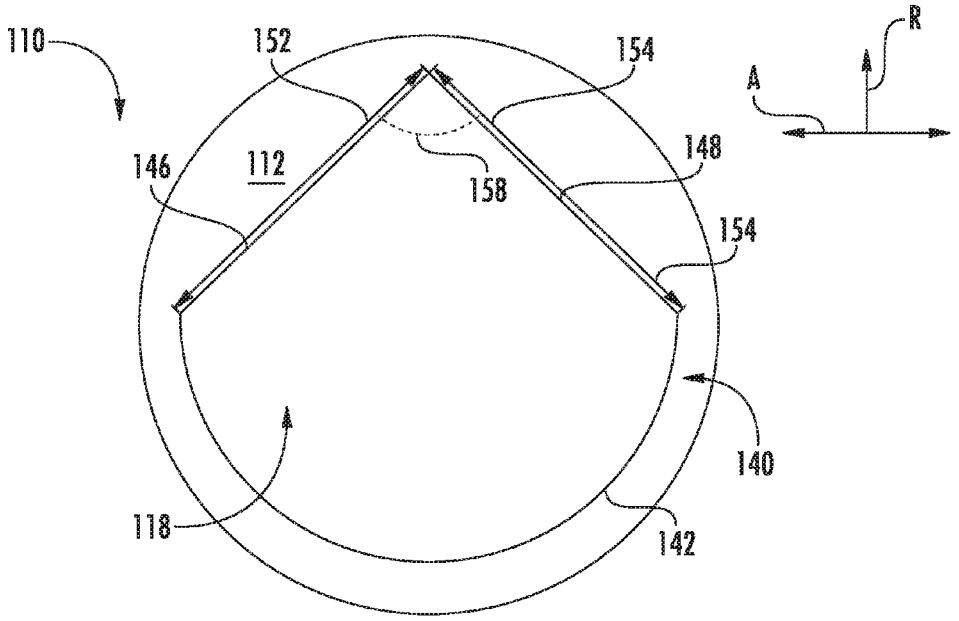
FIG. 8B is a front view of the nozzle shown in FIG. 6, illustrating another embodiment of a cross-sectional shape of the cooling passage.

FIGS. 7, 8A, and 8B illustrate one of the nozzles 110 in greater detail. As depicted therein, the nozzle 110 has a frustoconical shape. More specifically, the nozzle 110 extends circumferentially outwardly from the outer surface 108 of the insert wall 102 and terminates at an outer surface 112 of the nozzle 110. The outer surface 112 of the nozzle 110 is oriented parallel with and circumferentially spaced apart from the outer surface 108 of the insert wall 102. Furthermore, the radial length of the nozzle 110 decreases from the outer surface 108 of the insert wall 102 to the outer surface of the nozzle 110. The nozzle 110 also includes a circumferential surface 114.

In the embodiment shown in FIG. 7, the impingement insert 100 includes a pedestal 116 that supports the nozzle 110. As will be discussed in greater detail, the impingement insert 100 may formed via additive manufacturing methods. In this respect, the pedestal 116 provides the support necessary to form the nozzle 110 using additive manufacturing processes. As such, the pedestal 116 is positioned radially inward of the nozzle 110. In particular, the pedestal 116 includes a pedestal surface 162 extends circumferentially and radially outward from the outer surface 108 of the insert body 102 and couples to a portion of the circumferential surface 114 of the nozzle 110. In this respect, the pedestal 116 defines a pedestal angle 160 extending between the pedestal surface 162 and a circumferential line 164 extending circumferentially outward from the outer surface 108 of the insert wall 102. The pedestal angle 160 may be between thirty degrees and ninety degrees. In the embodiment shown in FIG. 7, the pedestal 116 has a triangular cross-sectional shape. Nevertheless, the pedestal 116 may have any suitable cross-sectional shape as well. Some embodiments, however, may not include the pedestal 116.

Figure 10:
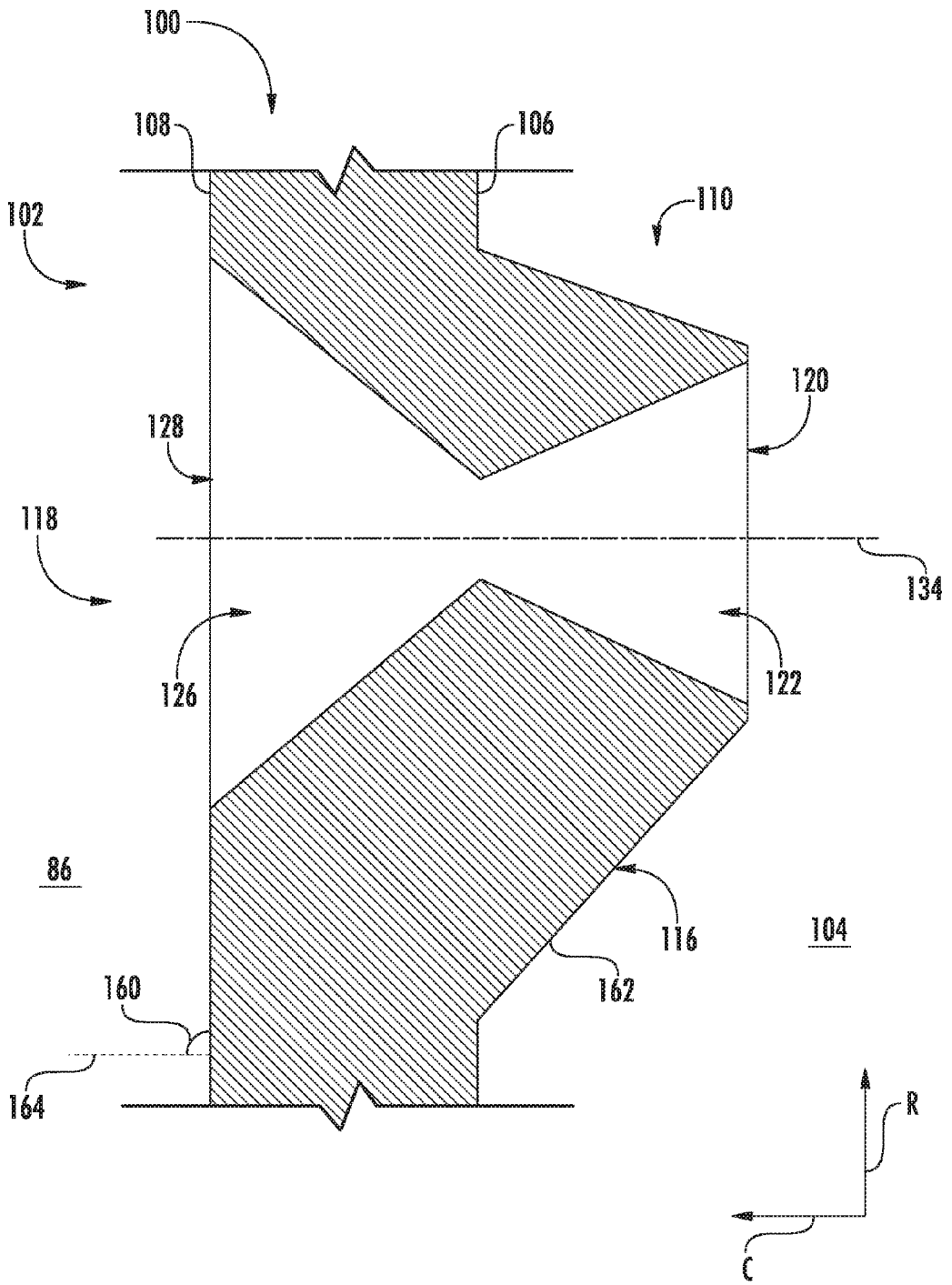
FIG. 10 is a partial cross-sectional view of the impingement insert similar to FIG. 7, illustrating another embodiment of the a nozzle.

FIG. 10 illustrated an embodiment of the impingement insert 100 where the pedestal angle is ninety degrees. In this embodiment, the outlet portion 128 is flush with the outer surface 108 of the insert body 102 as illustrated in FIG. 10. In this respect, the nozzle 110 may extend circumferentially inwardly from the outer surface 108 of the insert wall 102.

As illustrated in FIG. 7, the nozzle 110 and the insert wall 102 collectively define a cooling passage 118 extending therethrough. In particular, the cooling passage 118 extends from the inner surface 106 of the insert wall 102 to the outer surface 112 of the nozzle 110. In this respect, the cooling passage 118 fluidly couples the inner cavity 104 of the impingement insert 100 and the forward inner cavity 86 of the airfoil 50. As such, the cooling passage 118 provides impingement cooling to a portion of the inner surface 96 of the airfoil 50 as will be discussed in greater detail below.

The cooling passage 118 generally has a venturi-like configuration. More specifically, the cooling passage 118 includes an inlet portion 120, a converging portion 122, a throat portion 124, a diverging portion 126, and an outlet portion 128. The inlet portion 120 occupies the circumferentially innermost position of the cooling passage 118. In the embodiment illustrated in FIG. 7, the inlet portion 120 is entirely circumferentially aligned with the inner surface 106 of the insert wall 102. Nevertheless, the inlet portion 120 may extend circumferentially outward from the inner surface 106 of the insert wall 102 (i.e., into the insert wall 102) as well. The converging portion 122 extends from the inlet portion 120 to the throat portion 124. In particular, the diameter of the converging portion 122 narrows from the inlet portion 120 to the throat portion 124. The throat portion 124 generally occupies the portion of the cooling passage 118 having the smallest diameter. In this respect, the throat portion 124 is positioned at a central position along the circumferential length of the cooling passage 118. In the embodiment shown in FIG. 7, the throat portion 124 is circumferentially aligned with the outer surface 108 of the insert wall 102. Although, the throat portion 124 may be positioned circumferentially inward or outward of the outer surface 108 as well. The diverging portion 126 extends from the throat portion 124 to the outlet portion 128. The diameter of the diverging portion 126 expands from the throat portion 124 to outlet portion 128. The outlet portion 128 occupies the circumferentially outermost position of the cooling passage 118. In the embodiment illustrated in FIG. 7, the outlet portion 128 is entirely circumferentially aligned with the outer surface 112 of the nozzle 110. Nevertheless, the outlet portion 128 may extend from circumferentially inward from the outer surface 112 of the nozzle 110 (i.e., into the nozzle 110) as well.

The converging portion 122 and the diverging portion 126 define circumferential lengths. In particular, the converging portion 122 defines a converging portion length 130 extending circumferentially from the inlet portion 120 to the throat portion 124. Similarly, the diverging portion 126 defines a diverging portion length 132 extending circumferentially from the throat portion 124 to the outlet portion 128. In the embodiment shown in FIG. 7, the converging length 130 is the same as the diverging length 132. Although, the converging length 130 and the diverging length 132 may be different in other embodiments.

The converging portion 122 and the diverging portion 128 may respectively define converging and diverging angles. As illustrated in FIG. 7, the cooling passage 118 defines a circumferential centerline 132 extending therethrough. In this respect the converging portion 122 defines a converging portion angle 136 at which the converging portion 122 expands radially outwardly from the throat portion 124 to inlet portion 120 relative to the circumferential centerline 132. Similarly, the diverging portion 128 defines a diverging portion angle 138 at which the diverging portion 128 expands radially outwardly from the throat portion 124 to outlet portion 128 relative to the circumferential centerline 132. In the embodiment shown in FIG. 7, the converging portion angle 136 is greater than the diverging portion angle 138. The diverging portion angle 138 is preferably ten degrees, but may be as low as three degrees or high as fifteen degrees. The converging portion angle 136 is typically greater than fifteen degrees and may be as high as seventy-five degrees. Although, the converging portion angle 136 may the same as or smaller than the diverging portion angle 138 in other embodiments.

FIGS. 8A and 8B illustrate different embodiments of a cross-sectional shape 140 of the cooling passage 118. In particular, the cross-sectional shape 140 includes a semicircular portion 142 and a non-circular portion 144. The semicircular portion 142 is positioned radially inwardly from the non-circular portion 144. In the embodiments shown in FIGS. 8A and 8B, the semicircular portion 142 forms the radially inner half of the cross-sectional shape 140, while the non-circular portion 144 forms the radially outer half of the cross-sectional shape 140. In this respect, the non-circular portion 144 of the cross-sectional shape 140 is directly coupled to the semicircular portion 142 of the cross-sectional shape 140. Nevertheless, the semicircular and non-circular portions 142, 144 may occupy more or less than half of the cross-sectional shape 140 and may be spaced apart by other portions (not shown) of the cross-sectional shape 140.

FIG. 8A illustrates one embodiment of the non-circular portion 144 of the cross-sectional shape 140. As illustrated therein, the non-circular portion 144 includes a first linear side 146 and a second linear side 148. The first and the second linear sides 146, 148 extend radially outwardly and axially toward one another. In this respect, the first linear side 146 is oriented at an angle 158 relative to the second linear side 148. The angle 158 is between 60 degrees and 120 degrees in some embodiments. In certain embodiments, angle 158 may be 90 degrees. A fillet 150 couples the first and the second linear sides 146, 148. The non-circular portion 144, and more particularly the first and the second linear sides 146, 148, provide the support necessary to form the portions of the nozzle 110 circumferentially aligned with and positioned radially outwardly from the cooling passage 118 when using additive manufacturing processes.

FIG. 8B illustrates another embodiment of the non-circular portion 144 of the cross-sectional shape 140. The first and the second side linear sides 146, 148 extend radially outwardly and axially toward one another as with the embodiment shown in FIG. 8A. As such, the first linear side 146 is oriented at an angle 158 relative to the second linear side 148. The angle 158 is between 60 degrees and 120 degrees in some embodiments. In certain embodiments, angle 158 may be 90 degrees. In this embodiment shown in FIG. 8B, however, the first linear side 146 couples to the second linear side 148, thereby giving the non-circular portion 144 a triangular shape. Nevertheless, the non-circular portion 144 of the cross-sectional shape 140 may have any suitable non-circular shape.

The first and the second linear sides 146, 148 define lengths. In particular, the first linear side 146 defines a first linear side length 152, and the second linear side 148 defines a second linear side length 154. In the embodiment shown in FIG. 8B, the first linear side length 152 is the same as the second linear side length 154. In this respect, the non-circular portion 144 of the cross-sectional shape 140 is shaped like an isosceles triangle in the embodiment shown in FIG. 8B. Although, the first linear side length 152 and the second linear side length 154 may be different in other embodiments.

Preferably, the impingement insert 100 is integrally formed. In this respect, the insert wall 102, the nozzles 110, and the pedestals 116 are all formed as a single component. Nevertheless, the impingement insert 100 may be formed from two or more separate components as well.

As mentioned above, the impingement insert 100 is preferably formed via additive manufacturing. The term "additive manufacturing" as used herein refers to any process which results in a useful, three-dimensional object and includes a step of sequentially forming the shape of the object one layer at a time. Additive manufacturing processes include three-dimensional printing (3DP) processes, laser-net-shape manufacturing, direct metal laser sintering (DMLS), direct metal laser melting (DMLM), plasma transferred arc, freeform fabrication, etc. A particular type of additive manufacturing process uses an energy beam, for example, an electron beam or electromagnetic radiation such as a laser beam, to sinter or melt a powder material. Additive manufacturing processes typically employ metal powder materials or wire as a raw material. Nevertheless, the impingement insert 100 may be constructed using any suitable manufacturing process.

In operation, the impingement insert 100 provides cooling air 156 to the airfoils 50 of the nozzle 32B. As illustrated in FIG. 2, a portion of the compressed air 38 bled from the compressor section 12 (FIG. 1) is directed into the nozzle 32B. In particular, this portion of the compressed air 38 flows through the inner cavity 104 defined by the impingement insert 100 positioned in the forward cavity 86 of the nozzle 32B. In this respect, the compressed air 38 flows radially inwardly through the airfoils 50 of the nozzle 32B (i.e., from the outer side wall 48 toward the inner side wall 46). As will be discussed in greater detail below, the impingement insert 100 directs at least a portion of the compressed air 38 flowing through the inner cavity 104 onto the inner surface 96 of the airfoil 50. The portion of the compressed air 38 directed onto the inner surface 96 will hereinafter be referred to as the cooling air 156.

Figure 9:
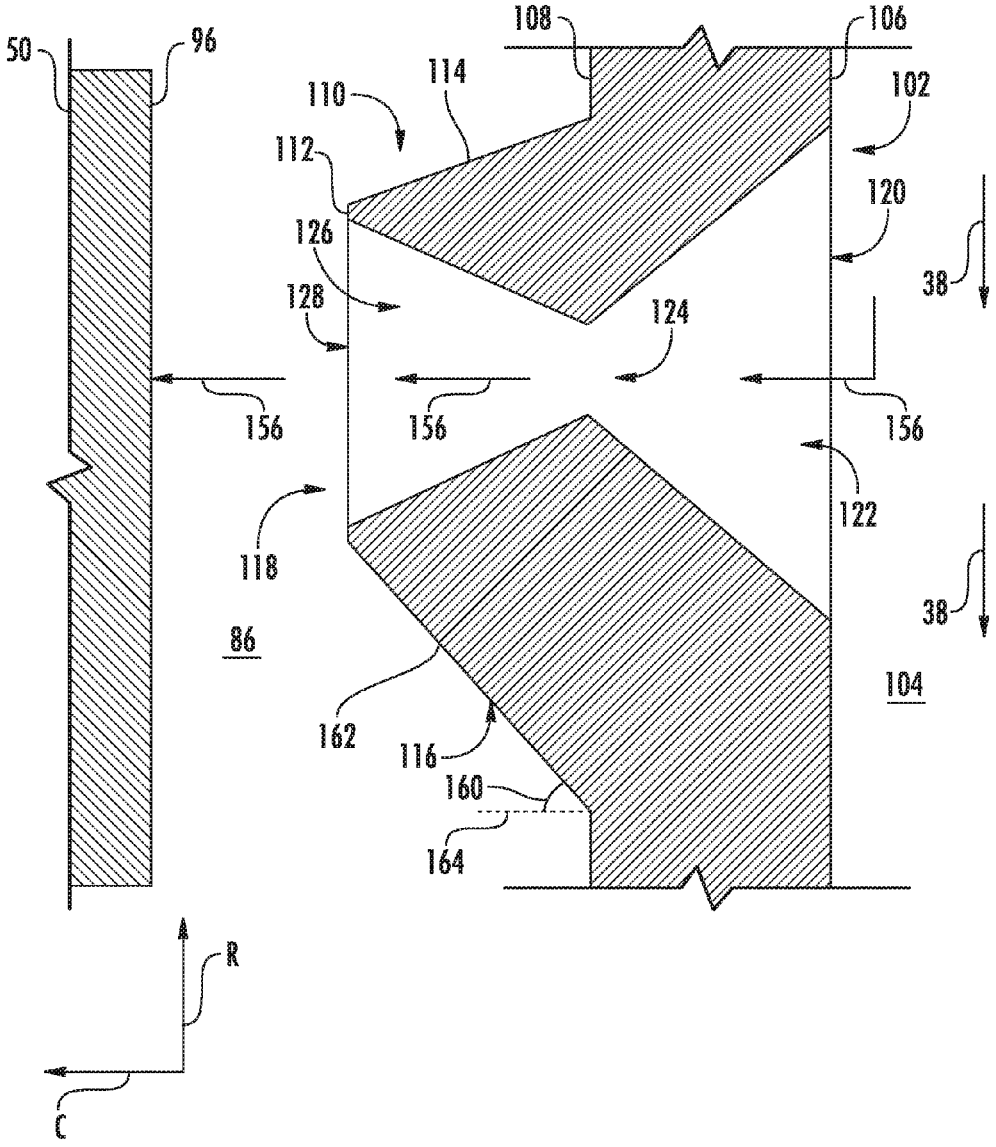
FIG. 9 is a partial cross-sectional view of the impingement insert similar to FIG. 7, illustrating cooling air flowing through the cooling passage.

As illustrated in FIG. 9, the cooling air 156 cools the inner surface 96 of the airfoil 50 via impingement cooling. More specifically, the cooling air 156 flows from the inner cavity 104 of the impingement insert 100 into inlet portion 120 of the cooling passage 118. The cooling air 156 flows sequentially through the inlet portion 120, the converging portion 122, the throat portion 124, the diverging portion 126, and the outlet portion 128 of the cooling passage 118. The venturi-like configuration of the cooling passage 118 increases the velocity of the cooling air 156 flowing therethrough. The cooling air 156 exits the cooling passage 118 and flows through the forward inner cavity 86 until striking the inner surface 96 of the airfoil 50. As such, cooling passage 118 provides impingement cooling to airfoil 50. In this respect, the nozzle 110 should have a circumferential length that permits impingement cooling of the airfoil 50. Furthermore, the cooling passage 110 should be sized and arranged to provide impingement cooling of the airfoil 50 as well.

As discussed in greater detail above, the venturi-like configuration of the cooling passage 118 increases the velocity of the cooling air 156 flowing therethrough. In this respect, each cooling passage 110 provides greater impingement cooling to the inner surface 96 of the airfoil 50 than conventional impingement cooling passages. As such, the impingement insert 100 may define fewer cooling passages 110 extending therethrough than conventional inserts having conventional impingement cooling passages. Accordingly, the impingement insert 100 diverts less compressed air 38 from the compressor section 12 (FIG. 1) than conventional inserts, thereby increasing the efficiency of the gas turbine engine 10.

The impingement insert 100 was discussed above in the context of the forward insert 90 positioned in the forward cavity 86 of the second stage nozzle 32B. Nevertheless, the impingement insert 100 may be any insert positioned in any cavity of any nozzle in the gas turbine engine 10. In some embodiments, the impingement insert 100 may be incorporated into one or more of the turbine shrouds 44A-44C or one or more of the rotor blades 32A-32C. In fact, the impingement insert 100 may be incorporated into any suitable component in the gas turbine engine 10.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An impingement insert for a gas turbine engine, comprising:

an insert wall comprising an inner surface and an outer surface spaced apart from the inner surface;

a nozzle extending at least one of outwardly from the outer surface of the insert wall and inwardly from the inner surface of the insert wall, the nozzle comprising an outer surface and a circumferential surface;

wherein the insert wall and the nozzle collectively define a cooling passage extending therethrough;

wherein the cooling passage comprises an inlet portion, a throat portion, a converging portion extending from the inlet portion to the throat portion, an outlet portion, and a diverging portion extending from the throat portion to the outlet portion; and wherein the cooling passage further comprises a cross-sectional shape, the cross-sectional shape comprising a semicircular portion and a non-circular portion, the non-circular portion of the cross-sectional shape comprising a first linear side and a second linear side, the first linear side and the second linear side coupled by a fillet portion.

2. The impingement insert of claim 1, further comprising:

a pedestal comprising a pedestal surface that extends outwardly from the outer surface of the insert wall and couples to a portion of the circumferential surface of the nozzle.

3. The impingement insert of claim 2, wherein the pedestal surface and a circumferential line extending circumferentially outwardly from the outer surface of the insert wall define a pedestal angle therebetween, and wherein the pedestal angle is between thirty degrees and ninety degrees.

4. The impingement insert of claim 2, wherein the insert wall, the nozzle, and the pedestal are integrally formed.

5. The impingement insert of claim 1, wherein the first linear side comprises a first linear side length and the second linear side comprises a second linear side length, and wherein the first linear side length is the same as the second linear side length.

6. The impingement insert of claim 1, wherein the first linear side and the second linear side define an angle therebetween, and wherein the angle is between 60 degrees and 120 degrees.

7. The impingement insert of claim 6, wherein the angle is 90 degrees.

8. The impingement insert of claim 1, wherein the semicircular portion of the cross-sectional shape couples directly to the non-circular portion of the cross-sectional shape.

9. The impingement insert of claim 1, wherein the semicircular portion of the cross-sectional shape is positioned radially inwardly from the non-circular portion of the cross-sectional shape.

10. The impingement insert of claim 1, wherein the converging portion comprises a converging portion length and the diverging portion comprises a diverging portion length, and wherein the converging portion length is the same as the diverging portion length.

11. The impingement insert of claim 1, wherein the converging portion comprises a converging portion angle and the diverging portion comprises a diverging portion angle, and wherein the converging portion angle and the diverging portion angle are different.

12. A gas turbine engine, comprising:

a compressor section;

a combustion section;

a turbine section;

a gas turbine engine component;

an impingement insert positioned within the gas turbine engine component, the impingement insert comprising:

an insert wall comprising an inner surface and an outer surface spaced apart from the inner surface;

a nozzle extending at least one of outwardly from the outer surface of the insert wall and inwardly from the inner surface of the insert wall, the nozzle comprising an outer surface and a circumferential surface;

wherein the insert wall and the nozzle collectively define a cooling passage extending therethrough;

wherein the cooling passage comprises an inlet portion, a throat portion, a converging portion extending from the inlet portion to the throat portion, an outlet portion, and a diverging portion extending from the throat portion to the outlet portion; and wherein the cooling passage further comprises a cross-sectional shape, the cross-sectional shape comprising a semicircular portion and a non-circular portion, the non-circular portion of the cross-sectional shape comprising a first linear side and a second linear side, the first linear side and the second linear side coupled by a fillet portion.

13. The gas turbine engine of claim 12, further comprising:

a pedestal comprising a pedestal surface extending outwardly from the outer surface of the insert wall and couples to a portion of the circumferential surface of the nozzle.

14. The gas turbine engine of claim 13, wherein the pedestal surface and a circumferential line extending circumferentially outwardly from the outer surface of the insert wall define a pedestal angle therebetween, and wherein the pedestal angle is between thirty degrees and sixty degrees.

15. The gas turbine engine of claim 12, wherein the first linear side and the second linear side define an angle therebetween, and wherein the angle is between 60 degrees and 120 degrees.

16. The gas turbine engine of claim 12, wherein the gas turbine component is a turbine nozzle or a turbine shroud.

* * * * *